US005329871A

United States Patent [19]

Gibbs

[11] Patent Number: 5,329,871

[45] Date of Patent: Jul. 19, 1994

[54] FOLD DOWN SEAT UTILIZING PIVOTALLY CONSTRUCTED BRACKET

[75] Inventor: Louie W. Gibbs, Clermont, Fla.

[73] Assignee: Classic Manufacturing Co., Inc., Clermont, Fla.

[21] Appl. No.: 34,876

[22] Filed: Mar. 19, 1993

[51] Int. Cl.[5] ..... B63B 17/00

[52] U.S. Cl. ..... 114/363

[58] Field of Search ..... 114/343, 363, 194, 188, 114/253, 364; 297/331, 332, 335, 336, 349; 248/158, 159, 415

[56] References Cited

U.S. PATENT DOCUMENTS

| | | | |
|---|---|---|---|
| 1,333,338 | 3/1920 | Polson | 297/349 |
| 3,376,587 | 4/1968 | Staron | 114/363 |
| 3,642,320 | 2/1972 | Ward | 114/363 |
| 3,884,522 | 5/1975 | Arima et al. | 297/63 |
| 4,566,734 | 1/1986 | Bruner | 297/346 |
| 4,587,921 | 5/1986 | Currey | 114/363 |
| 4,645,462 | 2/1987 | Fulton | 440/6 |
| 4,766,838 | 8/1988 | Johnson | 114/363 |
| 4,884,842 | 12/1989 | Finkelstein | 297/331 |
| 5,119,754 | 6/1992 | Martinez et al. | 114/363 |

FOREIGN PATENT DOCUMENTS 1234285 5/1986 U.S.S.R. .

*Primary Examiner*—Edwin L. Swinehart
*Attorney, Agent, or Firm*—Julian C. Renfro

[57] ABSTRACT

A pivoting bracket for supporting a boat seat at an appropriate position above the deck of a boat, such bracket permitting the seat normally to remain upright, but also to be pivoted, on occasion, into a low center of gravity position adjacent the deck, thus to provide better visibility to the person operating the boat. This bracket comprises a pair of interfitting members, with one of these members being a clevis-shaped first member having spaced-apart portions, and the second member being interposed between the spaced-apart portions. A pivot pin extends through the spaced-apart portions of the first member as well as through the second member, the pivot pin permitting the members to reside in an aligned relationship when the seat is intended to reside in an upright position. The pivot pin also permits the members to reside in an angular attitude when the seat is to be moved out of the upright position. An appropriately placed locking device enables the members to be locked in an aligned relationship, such that a user may sit on the seat without the seat possibly moving into an unusable position. The locking device is preferably a spring biased locking pin that can be moved into any one of a number of possible locking positions, so that the seat may be held in a desired relationship to the deck.

17 Claims, 4 Drawing Sheets

FOLD DOWN SEAT UTILIZING PIVOTALLY CONSTRUCTED BRACKET

BACKGROUND OF THE INVENTION

It is well known that fishing boats approximately 17 feet long are often fitted with a rather tall seat, located forward of the location where the boat is steered. Such a seat is usually supported by a relatively long pedestal whose lower end fits into a hole or fitting of suitable size located in the deck of the fishing boat.

The seat typically rests comparatively high above the deck, so in the interests of providing the fisherman with a clear view of the waterway ahead, the seat and its pedestal is ordinarily placed in a substantially flat position on the deck while the boat is underway, but is then placed in the operational, usable position when the fishing grounds are reached. The fisherman almost always finds the seat comfortable as well as advantageous to utilize while fishing, particularly when a long wait may ensue between catches.

When moving from one fishing spot to another, however, there is a temptation to travel with this forwardly-located seat in the upstanding, deployed position, without going to the trouble to remove it from its deck fitting, and laying it flat on the deck. Unfortunately, if the seat is left in the deployed position, it may well jump out of its deck fitting if the wake of another boat is encountered, with the consequence that the seat (and pedestal) will fly rearwardly and strike the driver of the boat, or cause other damage.

It was in a n effort to overcome the danger of a dislodged seat causing damage to a fishing boat or to the occupants thereof that the present invention was evolved.

SUMMARY OF THE INVENTION

In accordance with this invention, the ordinary straight rod pedestal used to support a seat in a forwardly-located portion on a fishing boat is replaced by a novel pivoted fitting, involving a hinged bracket utilized a relatively short distance above deck level. In this way, the seat and pedestal can remain attached to the deck and used quite safely and comfortably when in its deployed position, and still be folded down to rest on the deck in a relatively safe position while the boat is traveling from one fishing spot to another.

Thereafter, when the new fishing spot is reached, it is but a simple matter to rotate the pivotally constructed bracket 90° back to the upright position, and then resume fishing with the seat in a usable position. A spring biased locking pin is utilized in the bracket for preventing the seat and pedestal folding over while in use.

Now in more detail, my invention involves a pivotally constructed bracket comprising a pair of interfitting members, with one of these members being a generally clevis-shaped first member having spaced-apart portions, and the other being a relatively flat second member interposed between the spaced-apart portions.

A pivot pin extends through the spaced-apart portions of the first member as well as through the second member, with this pivot pin permitting the members to reside in what I regard as an aligned relationship when the seat is intended to reside in an upright position. This arrangement also permits these interfitting members to assume an angular relationship when it is desirable for the seat to be folded over, to provide increased visibility for the rive of the boat. So as to prevent the seat moving into its inactive or storage position when a fisherman is sitting on it, the readily utilized spring biased locking means I provide enables the relatively movable members to be locked in an aligned relationship, thus providing a desirable amount of safety.

As will be seen in more detail hereinafter, the seat may be readily stored in the inactive or bent over position when the boat is traveling from one location to another, with the attachment of the fitting to the deck preventing the seat from becoming airborne and causing danger to the boat or to its occupants should the wake of another boat or a similar disturbance be encountered. Because the folding over of the seat to a position adjacent the deck lowers its center of gravity, the seat is less likely to have a tendency to become airborne when the boat encounters fairly strong wave action.

So that the fisherman will not fear the seat folding over inadvertently when he is sitting in it, the aforementioned locking pin can remain in a basic, locking relationship to the relatively movable members, with relative movement of the members being permitted only at such time as a spring force normally holding the locking pin in its functional position has been overcome by a distinct pull of the locking pin by the fisherman.

It is therefore a primary object of this invention to provide a highly advantageous yet economical pivoting bracket or deck fitting for supporting a seat in a fishing boat, which installation can be easily made and safely used by fishermen.

It is another object of this invention to provide a greatly improved mounting arrangement for a boat seat, that will readily permit the seat to be moved out of the line of vision of the person controlling the boat, as well as eliminating the threat of the seat becoming dislodged and causing injury or damage should the boat encounter substantial wave action.

It is yet another object of this invention to provide a highly advantageous pivotable bracket for safely supporting a fisherman's seat in the upright position while a fisherman is fishing, but readily permitting the seat to be moved into a folded-over, low center of gravity position when the boat is underway, thus to improve visibility as well as lessening the likelihood of the sat flying out of its deck mounting and causing injury or damage should the boat encounter substantial wave action, such as the wake of another boat.

It is yet still another object of this invention to provide a highly advantageous pivotable bracket for safely supporting a fisherman's seat in the upright position while a fisherman is fishing, with this bracket having a plurality of settings or operative positions, readily permitting the seat to be moved into a partially folded-over position or, alternatively, a fully laid over position when the boat is underway, thus improving visibility and lessening the likelihood of injury or damage.

These and other objects, features and advantages will become more apparent as the description proceeds.

DETAILED DESCRIPTION

Figure 1:
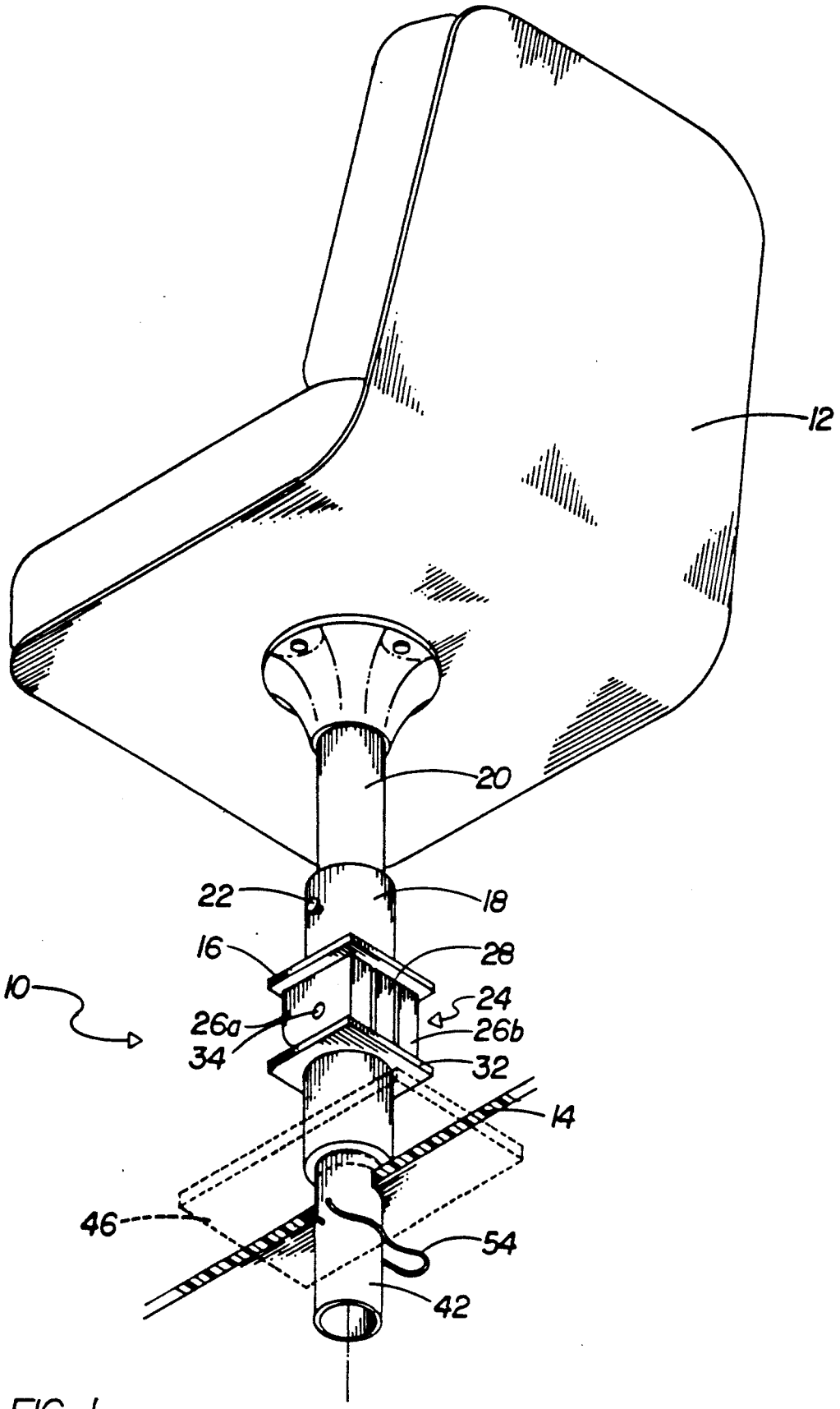
FIG. 1 is a perspective view from below of my novel mounting bracket, here shown supporting a boat seat in the fully operative position.

With initial reference to FIG. 1, it will be seen that I have provided a pivotally constructed bracket 10 for supporting a boat seat 12 on the deck 14 of a boat. From this figure it can be seen that the pivotally constructed bracket consists of several portions, including an upper mounting member 16, a lower mounting member 32 and a clevis-shaped member 24 extending in an operative manner therebetween, which bracket member 10 is responsible for enabling the seat 12 to be readily moved from an operational position, into an out-of-the-way position adjacent the deck of the boat at the behest of the boater. As will be obvious, when the seat is close to, or in contact with the deck, it presents a lower center of gravity than when in the upright position.

A generally cylindrical seat-receiving member 18 is supported from the upper mounting member 16, and on the underside of the seat 12 is provided a pedestal member 20. As will be noted from FIG. 1 as well as in more detail in subsequent figures, the pedestal member 20 is readily received in the seat-receiving member 18. A lock screw 22 in member 18 is provided so that the user, by tightening the screw 22, may effectively prevent the pedestal 20 of the seat 12 from undesirably becoming detached from the seat-receiving member 18. It is to be understood that I am not to be limited to the type of seat indicated at 12 in FIG. 1.

Figure 2:
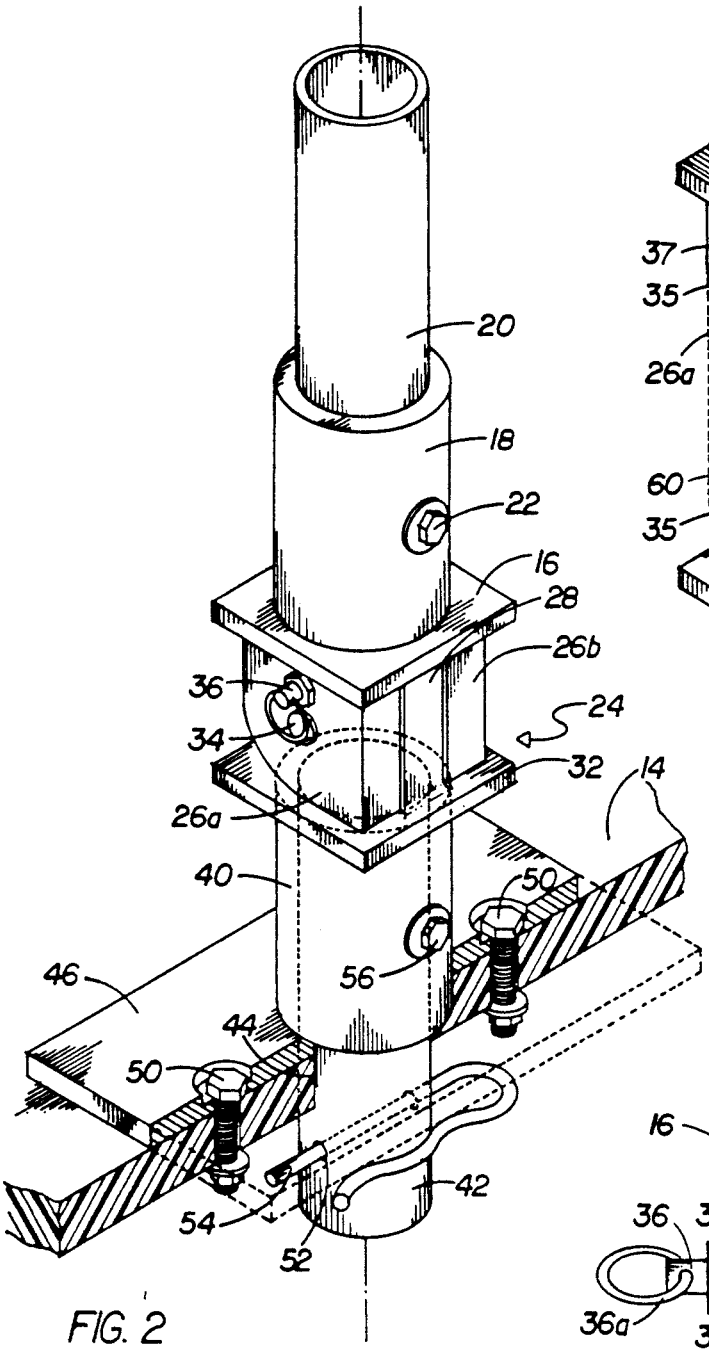
FIG. 2 is a perspective view somewhat from above, showing additional details of my novel, pivotally constructed mounting bracket, with the locking pin, the mounting plate on the deck and other significant details being herein revealed.
Figure 2A:
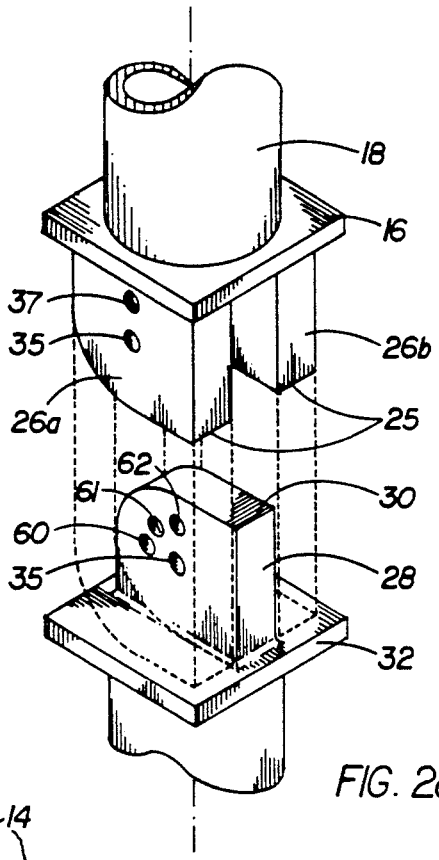
FIG. 2*a* is an exploded view of the components constituting my novel, pivotally constructed mounting bracket.

With reference to the construction I prefer for bracket 10, it is to be seen from FIGS. 2 and 2*a* that to the underside of the upper mounting member 16 is rigidly attached a clevis-shaped member 24. The member 24 may hereinafter be referred to as the first member, and this member 24 is constituted by spaced apart portions 26*a* and 26*b*.

Extending between the spaced apart portions 26*a* and 26*b* is a second member 28, which in this instance is rigidly attached to lower mounting member 32. The member 28 is of essentially flat construction with certain rounded upper portions, and from the thickness standpoint it is sized to be able to move easily relative to the spaced apart portions 26*a* and 26*b* at such time as the seat is moved between the operational position and a selected out-of-use position.

FIGS. 1 and 2 reveal that a hinge pin 34 extends through both of the spaced apart portions of the clevis-shaped member 24, as well as through the second member 28 that extends upwardly from the lower mounting member 32. It is about the hinge pin 34 that the spaced apart portions 26*a* and 26*b* move when the fisherman repositions the seat from the upright position to an out-of-use or storage position. FIG. 2*a* reveals that I provide a hole 35 in member 26*a* as well as a hole by the same designation in upstanding member 28, for the hinge pin 34 extends from member 26*a* through the member 28 and thereafter through the member 26*b*.

It is obviously necessary to provide certain means for assuring that the seat remains in the desired upright position when in use, which upright position is of course depicted in FIGS. 1 and 2. To this end, I provide a locking pin 36, visible in place in FIG. 2, and in cross-sectional detail in FIG. 2*b*. The body portion of the locking pin 36 is provided with external threads, which are received in threaded hole 37 created in the member 26*a*, best seen in FIGS. 2*a* and 2*b*.

FIG. 2*a* reveals that the threaded hold 37 for receiving the locking pin 36 is a fixed distance from the hole 35 in which the hinge pin 34 is inserted, and the same fixed distance also exists between the hold 35 in member 28, and each of the arcuately located holes 60, 61 and 62 that have been drilled or otherwise formed in the member 28 at spaced intervals along an arc about the hole 35. In other words, each of the holes 60, 61 and 62 are at a constant radius about the hole 35.

Figure 2B:
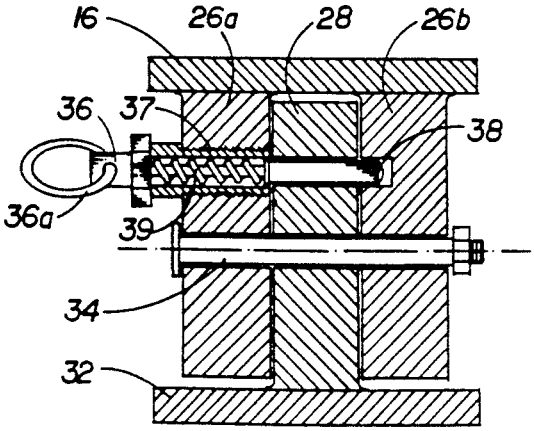
FIG. 2*b* is a fragmentary view of a spring biased locking pin of the type I prefer to utilize in conjunction with my bracket.

FIG. 2*b* reveals that the locking pin 36 has an internal portion including an elongate pin or shaft 38, and a compression spring 39. The spring 39 is normally effective to hold the elongate pin in the position shown in FIG. 2*b*, wherein the pin 38 extends through aligned holes in members 28 and 26*b*. When, however, the user pulls on ring 36*a* with sufficient force, the elongate pin portion 38 is withdrawn from contact with the members 26*b* and 28, thus permitting the boater to move the member 28 about the hinge pin 34.

As a result of this construction, when the elongate locking pin portion 38 of the locking pin 36 is in hole 62 of the member 28, the seat 12 as well as the members 18 and 20 are maintained in the upright position shown in FIGS. 1 and 2. On the other hand, when the locking pin has been fully withdrawn from contact with the member 28, the components 16, 18, 26*a* and 26*b* of FIG. 2*a* can be rotated about the hinge pin 34. When these components have been rotated approximately 45°, the arrangement of components depicted in FIG. 3 results. If the ring 36*a* of locking pin 36 is released at this time, the hole 61 will be engaged by the pin or shaft 38, and the components 16, 18 and 20 as well as the seat 12 will be maintained in this angular position.

Figure 4:
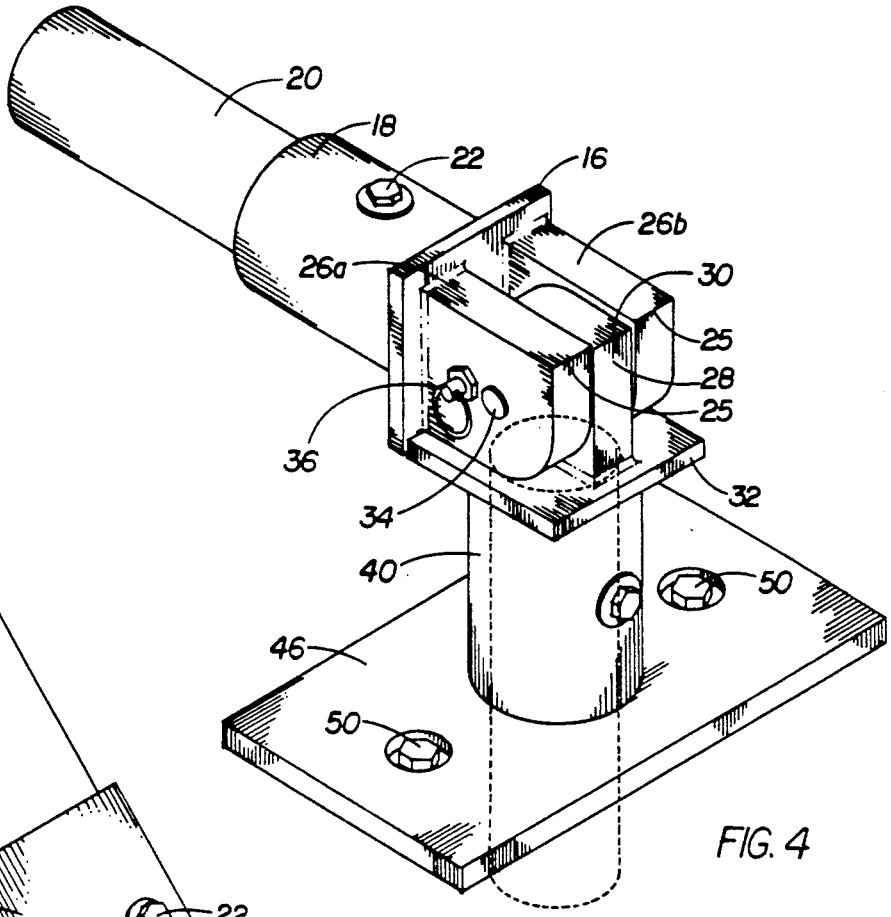
FIG. 4 is a view showing the mounting bracket in the fully laid over position.

On the other hand, if the locking pin 36 continues to be held in the withdrawn position against the bias of spring 39, the components 16, 18, 26*a* and 26*b* can be rotated about the hinge pin 34 for approximately 90°, resulting in the hold 60 being engaged when the pin or shaft 38 is released. The arrangement of components as depicted in FIG. 4 will result, with the boat seat 12 being either in contact with the deck or nearly in contact with the deck at that time. As is obvious, with the boat seat 12 in a laid over position, substantially increased visibility for the person concerned with driving the boat is made possible. In addition, the seat then presents a substantially lowered center of gravity, with this necessarily lessening the likelihood of the seat becoming dislodged and causing damage to the occupants or to the boat should intense wave action be encountered.

Figure 6:
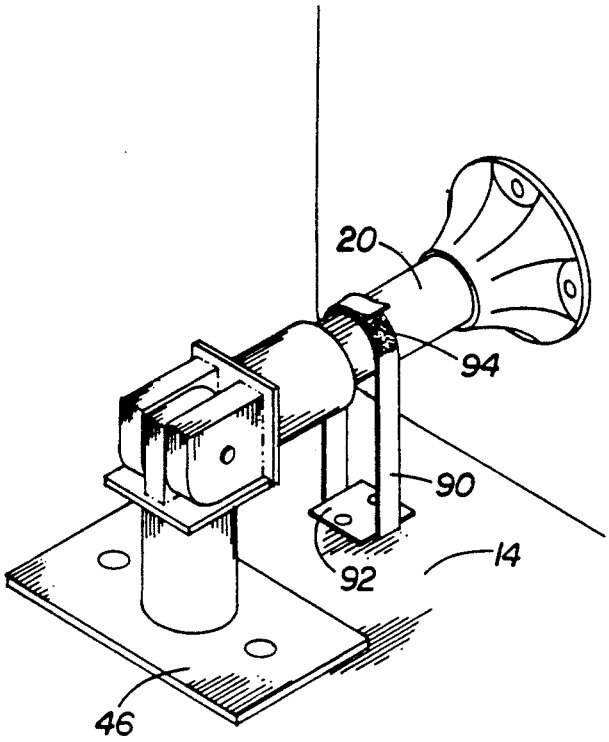
FIG. 6 is a view to a somewhat smaller scale, illustrating the use of a strap mounted to the deck of the boat, which strap functions to prevent the seat from moving about the deck when in the folded over position.
Figure 7:
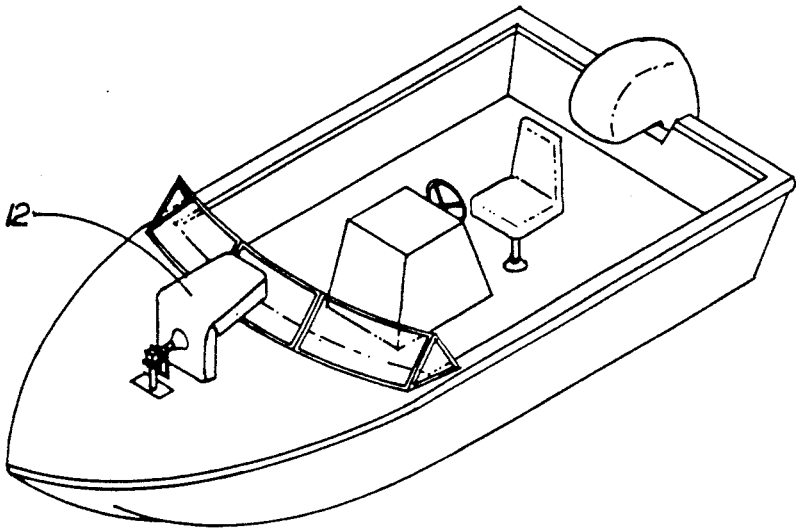
FIG. 7 is a view to a still smaller scale, showing one example of the positioning of the seat on the deck when it has been moved to its low center of gravity, folded over position.

In the interests of safety, I may provide anchoring means for the seat on the deck of the boat, and this, for example, can take the form of a strap 90, as shown in FIG. 6. The mid portion of the strap 90 is affixed to the deck, such as by a plate 92, with snaps, Velcro® hook and loop fasteners 94 or other fastening means utilized on the ends of such strap. In this way the strap can be passed around the pedestal 20 or other component of the seat and the ends then fastened together, as shown in FIG. 7. In this way any movement of the seat around the deck when the boat is underway can be effectively prevented.

Figure 3:
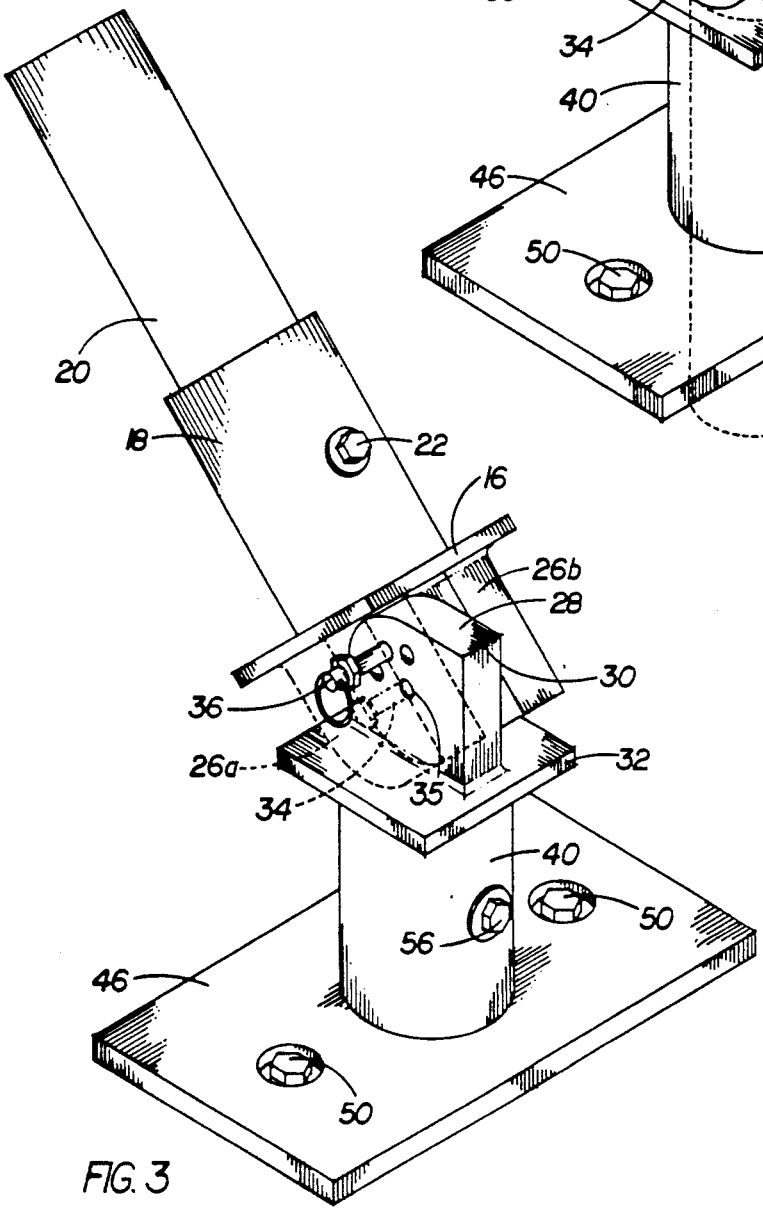
FIG. 3 is a view showing my pivotally constructed mounting bracket in accordance with this invention in a partially bent over position.

FIG. 2*a* reveals that a part of the second member 28 as well as a part of the clevis members 26*a* and 26*b* possess an amount of curvature, so that it will be possible to bend the clevis members 26*a* and 26*b* with respect to the member 28, to the positions illustrated in FIGS. 3 and 4. It is to be noted, however, that the member 28 is provided with a protruding portion 30 that forms an obstruction directly preventing the upper mounting member 16 from moving past the vertical position shown in FIG. 2. Were it not for the protruding portion 30 and/or the utilization of protruding portions 25 on the components 26*a* and 26*b* constituting the clevis-shaped member 24, it would, quite understandably, be possible for the seat 12 to move beyond the desired upright position at such time as the fisherman is attempting to raise the seat from the out-of-use or storage position in order to place it in the operational position. This type of situation is obviously to be prevented, and is prevented by the use of the above-described construction.

Turning now to other aspects of construction of my invention, and with reference to FIG. 2, it is to be seen that extending downwardly from the lower mounting member 32 is a relatively short mounting post 40, which is preferably of hollow construction, and equipped with a downwardly extending reduced diameter portion 42. The portion 42 is of elongate configuration, and extends through an appropriate aperture 44 provided in the deck 14. Many boats are manufactured with a sturdy mounting plate affixed to the deck. Accordingly, I prefer to utilize my novel fold down seat arrangement in conjunction with a plate 46 equipped with a central aperture 48. The plate 46 is secured by bolts 50 equipped with nuts to the deck 14. The use of the mounting plate 46 on the deck prevents damage to the deck 14 as the fisherman rotates the boat seat 12 from side to side about its mounting during vigorous use.

As best seen in FIG. 2, a hole 52 extends transversely through a lower portion of the reduced diameter portion 42, and through this hole 52 a retention means in the form of a retention pin 54 extends, thus preventing any tendency for the mounting post 42 coming entirely out of the deck at the time the boat encounters large waves. A bolt 56 is used to secure the reduced diameter portion 42 inside the mounting post 40.

As will be apparent from a careful study of FIGS. 2 through 4, the portions 26*a* and 26*b* move together about the hinge pin 34 with respect to flat, vertically-extending member 28, between the upright position depicted in FIG. 2, and the folded-over or storage positions depicted in FIGS. 3 and 4. As will be readily apparent, when the members are in the relationship depicted in FIGS. 1 and 2, a fisherman may safely sit on the seat member 12. This safety is guaranteed by the use of the aforementioned spring biased locking pin 36 that is normally spring biased into engagement with the flat second member 28.

As should now be obvious to those skilled in the art, the pivot pin or hinge pin 34 permits the clevis-shaped member 24 and the flat second member 28 to reside in an aligned relationship when the seat 12 is intended to reside in the upright position depicted in FIGS. 1 and 2, as well as in a desired angular attitude as depicted in FIGS. 3 and 4, when the seat has been folded over into the position affording the boat driver better visibility. As mentioned hereinabove, the mounting post 40 is relatively short so that the folding bracket member 10 will be closer to the deck 14 than to the seat 10, thus to assure a relatively low center of gravity.

Figure 5:
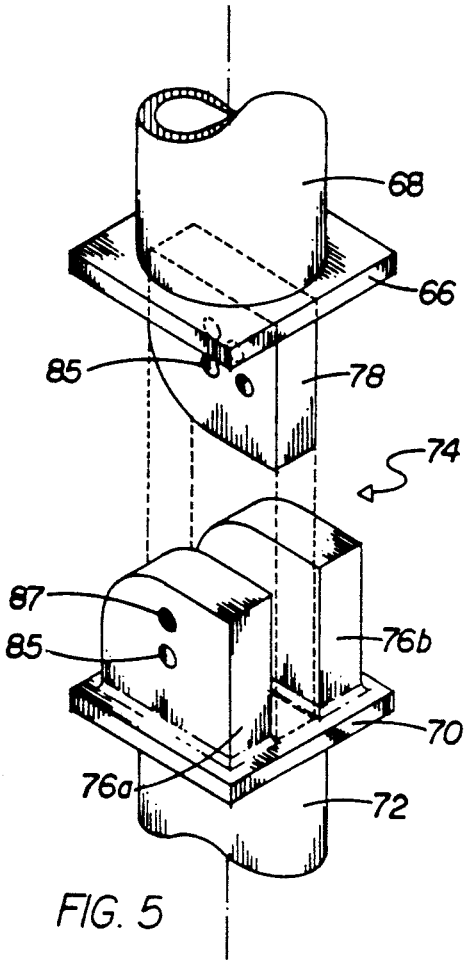
FIG. 5 is an exploded view revealing an alternative construction for the mounting bracket.

With reference now to FIG. 5, it will be seen that I have shown a variation on the above-described arrangement, in that the clevis member 74 is made up of spaced apart members 76*a* and 76*b* that are rigidly mounted on lower mounting member 70, whereas the flat member 78 is rigidly mounted on the underside of upper mounting member 66. Above the upper mounting member 66 is of course the seat-receiving member 68, into which the pedestal 20 mounted to the underside of the seat extends. Below the lower mounting member 70 is of course the relatively short mounting post 72 that carries the weight of the bracket member and seat. The bottom of the mounting post is in contact with the mounting plate (not shown) affixed to the boat deck.

A suitable hinge pin is inserted through the holes 85 located in the members 76*a*, 76*b* and 78, so that the counterpart of the pivotal arrangement described in conjunction with FIGS. 2 through 4 can be created. As before, a spring biased locking pin is threadedly installed in threaded hole 87 of the member 76*a*, so that a desired locking relationship with a selected one of the arcuately located holes in member 78 can be achieved.

It should now be apparent that I have described a pivotal bracket ideal for use in mounting a foldable seat on the deck of a boat with this bracket being utilized in conjunction with a retention pin preventing the bracket and seat being dislodged from the deck and causing injury or damage should substantial wave action be encountered. Because my novel bracket readily permits the entire seat to be folded into a low center of gravity position, in which it is out of the boat pilot's line of vision, the boater or fisherman can avoid the difficulty usually involved in removing the seat and its support from the deck fitting, and thereafter having to replace the seat at the time of reuse.

I am not to be limited to any particular constructional materials, but I found in several prototypes that aluminum is usually a very satisfactory metal to use in constructing the member generally of clevis shape, and the member extending therebetween, which members are of course hingedly joined together by the hinge pin. Such members are welded to the respective upper and lower mounting members by the use of heliarc welding techniques. In highly corrosive environments, stainless steel may be the preferred metal to use in constructing the members constituting the pivotally constructed bracket.

As shown in FIG. 7, the strap arrangement 90 of FIG. 6 can be used to restrain the seat when folded to a position adjacent the deck, such that the seat will not change its position on the deck.

I claim:

1. A pivoting bracket for supporting a boat seat upon a pedestal rigidly affixed to the deck of a boat, such bracket enabling the seat normally to remain upright, but also permitting the seat to be pivoted, on occasion, over into a low center of gravity position adjacent the deck, said bracket comprising a pair of interfitting first and second members, a pivot pin extending through said first and second members, said pivot pin permitting said members to reside in an aligned relationship when the seat is intended to reside in an upright position, as well as in a n angular attitude when the seat has been folded over into a position close to the deck, in which position the seat resides at an angle to the vertical, and locking means enabling said members to be locked in the aligned relationship, such that a user may sit on the seat without the seat possibly moving into an unusable position, said locking means being a spring biased locking pin integral with said first and second members and utilized for locking said first and second members together when such members are disposed in a desired relationship.

2. The pivoting bracket for supporting a boat seat as recited in claim 1 in which a lower portion of said bracket is of elongate construction, and adapted to extend through a hole provided in the deck of the boat.

3. The pivoting bracket for supporting a boat seat as recited in claim 2 in which said lower portion of said bracket is provided with a transverse hole, through which a retention means extends.

4. A pivoting bracket for supporting a boat seat on the deck of a boat, such bracket permitting the seat normally to remain upright, but also to be pivoted, on occasion, into a low center of gravity position closely adjacent the deck, said bracket comprising a pair of interfitting members, one of said members being a clevis-shaped first member having spaced-apart portions, and the second member being interposed between said spaced-apart portions, said bracket being rigidly supported above the deck by a relatively short mounting means, such that said bracket is disposed closer to the deck than to the seat, a pivot pin extending through said spaced-apart portions of said first member as well as through said second member, said pivot pin permitting said members to reside in an aligned relationship when the seat is intended to reside in an upright position, as well as to reside in a n angular attitude when the seat has been moved out of the upright position, and locking means enabling said members to be locked in an aligned relationship, such that a user may sit on the seat without the seat possibly moving into an unusable position, the support of said bracket relatively close to the deck by said relatively short mounting means, enabling the entire seat to be folded over into a low center of gravity position closely adjacent the deck at such time as said members have been caused to reside in the angular attitude.

5. The pivoting bracket for supporting a boat seat as recited in claim 4 in which said first member is operatively associated with the boat seat, whereas said second member is operatively associated with the deck upon which said bracket is supported.

6. The pivoting bracket for supporting a boat seat as recited in claim 4 in which said first member is operatively associated with the deck upon which said bracket is supported, whereas said second member is operatively associated with the boat seat upon which the fisherman sits.

7. The pivoting bracket for supporting a boat seat as recited in claim 4 in which said locking means is a spring biased locking pin utilized for locking said first and second members together when disposed in an aligned relationship.

8. The pivoting bracket for supporting a boat seat as recited in claim 4 in which a lower portion of said bracket is affixed to a mounting post designed to carry the weight of the seat and said bracket, with a lower portion of said mounting post being adapted to extend through a hole provided in the deck of the boat.

9. The pivoting bracket for supporting a boat seat as recited in claim 8 in which said mounting post is comparatively short, such that said bracket is disposed closer to the deck than to the seat.

10. The pivoting bracket for supporting a boat seat as recited in claim 8 in which said lower portion of said mounting post is provided with a transverse hole, through which a retention means extends, thus to prevent said mounting post and bracket from coming out of the deck as a result of boat motion.

11. A pivoting bracket for supporting a boat seat on the deck of a boat, such bracket permitting the seat normally to remain upright, but also to be pivoted over into a low center of gravity position closely adjacent the deck on occasion, said bracket comprising a pair of interfitting members, one of said members being a clevis-shaped first member having spaced-apart portions, and a second member interposed between said spaced-apart portions, said bracket being rigidly supported above the deck by a relatively short mounting means, such that said bracket is disposed closer to the deck than to the seat, a hole formed through said spaced-apart portions of said first member as well as through said second member, through which hole a pivot pin extends, said pivot pin permitting said members to reside in an aligned relationship when the seat is intended to reside in an upright position, as well as to reside in an angular attitude when the seat has been folded over into a position away from the vertical, a plurality of spaced apart, arcuately placed holes in said second member, each of said holes being located at a substantially identical radius with respect to the hole through which said pivot pin extends, and locking means forming an integral part of said bracket, said locking means enabling said members to be locked in a desired rotational relationship, the particular relationship depending upon which of said arcuately placed holes is selected for entry by said locking means, said bracket, by being supported relatively close to the deck by said relatively short mounting means, thus enabling the entire seat to be folded over into a location relatively close to the deck, so as to place the seat in a low center of gravity position.

12. The pivoting bracket for supporting a boat seat as recited in claim 11 in which said first member is operatively associated with the boat seat, whereas said second member is operatively associated with the deck upon which said bracket is supported.

13. The pivoting bracket for supporting a boat seat as recited in claim 11 in which said first member is operatively associated with the deck upon which said bracket is supported, whereas said second member is operatively associated with the boat seat upon which the fisherman sits.

14. The pivoting bracket for supporting a boat seat as recited in claim 11 in which said locking means is a spring biased pin utilized for locking said first and second members together when disposed in an aligned relationship.

15. The pivoting bracket for supporting a boat seat as recited in claim 11 in which a lower portion of said bracket is affixed to a mounting post designed to carry the weight of the seat and said bracket, with a lower portion of said mounting post being adapted to extend through a hold provided in the deck of the boat.

16. The pivoting bracket for supporting a boat seat as recited in claim 15 in which said mounting post is comparatively short, such that said bracket is disposed closer to the deck than to the seat.

17. The pivoting bracket for supporting a boat seat as recited in claim 15 in which said lower portion of said mounting post is provided with a transverse hole, through which a retention means extends, thus to prevent said mounting post and bracket from coming out of the deck as a result of boat motion.

* * * * *